US007641515B1

(12) United States Patent
Szczesny et al.

(10) Patent No.: US 7,641,515 B1
(45) Date of Patent: Jan. 5, 2010

(54) CENTER PLATE FOR A CONNECTOR ASSEMBLY

(75) Inventors: David S. Szczesny, Hershey, PA (US); Michael Eugene Shirk, Grantville, PA (US); Michael J. Phillips, Camp Hill, PA (US); Keith McQuilkin Murr, York, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/196,140

(22) Filed: Aug. 21, 2008

(51) Int. Cl.
*H01R 13/648* (2006.01)

(52) U.S. Cl. ..... 439/607; 439/541.5

(58) Field of Classification Search ..... 439/607, 439/541.5
See application file for complete search history.

(56) References Cited

U.S. PATENT DOCUMENTS 6,478,622 B1 11/2002 Hwang
6,558,191 B2 5/2003 Bright et al.
6,943,287 B2 9/2005 Lloyd et al.
7,001,217 B2 2/2006 Bright et al.
7,070,446 B2 * 7/2006 Henry et al. ..... 439/541.5
7,249,966 B2 * 7/2007 Long ..... 439/541.5
7,357,673 B2 * 4/2008 Long ..... 439/608
2008/0057786 A1 * 3/2008 Gu et al. ..... 439/607
2008/0299826 A1 * 12/2008 Cheng et al. ..... 439/607

* cited by examiner

*Primary Examiner*—Hae Moon Hyeon

(57) ABSTRACT

A connector assembly includes a shielding cage and a center plate. The shielding cage includes side walls with ports disposed between the side walls. The ports are configured to receive a mating connector through a mating interface of the shielding cage. The center plate is disposed between and couples the side walls to one another. The center plate separates the ports and includes dividing plates and a connecting plate formed with the dividing plates. The dividing plates include spring members extending into the ports to engage the mating connectors received in the ports. The connecting plate extends along the mating interface to interconnect the dividing plates at a location proximate to the mating interface.

17 Claims, 6 Drawing Sheets

CENTER PLATE FOR A CONNECTOR ASSEMBLY

BACKGROUND OF THE INVENTION

The subject matter herein generally relates to electrical connector assemblies and, more particularly, to center plates for connector assemblies.

Known connector assemblies are shaped to receive one or more mating connectors. These connector assemblies include ports through which the mating connectors are loaded. For example, some known connector assemblies include shielding connector cages that include several ports. The connector cages include walls that define the ports. The walls are electrically grounded to shield other components near the connector cage from electromagnetic interference.

The connector cages have a mating interface through which the mating connectors are loaded into the ports. The ports are separated from one another by a center plate. The mating connectors are loaded into the ports to mate with electrical connectors located in the connector assemblies. The center plate in each of the ports includes a spring member that extends into the port and engages the mating connector that is loaded into the port to retain the mating connector in the port. The center plates for adjacent ports are separated by gaps. The center plates may be separate components, or may be components that are coupled together in a location remote from the mating interface of the connector cage. The gap between the center plates provides a path for electromagnetic interference to radiate from the connector cage. Some known connector cages attempt to reduce the amount of electromagnetic interference that radiates through the gap between the center plates by adding an additional component that closes off the gap. Yet, introducing additional components to the connector cages increases the cost and complexity of manufacturing the connector cages.

Some known connector assemblies having connector cages include one or more indicator lights. These indicator lights are disposed in one or more of the ports. The indicator lights emit a light that indicates a state of one or more connectors located in the connector cage. For example, indicator lights such as one or more light pipes may emit a light that indicates that a mating connector is in communication with a connector located in the connector cage. Placing these indicator lights in the ports of the connector cage, however, consumes valuable space in the connector cage. For example, a mating connector cannot be loaded into a port that includes the indicator lights. As a result, fewer ports are available for mating connectors to be loaded into in order to mate with the connectors in the connector cage. In other known connector assemblies, the indicator lights are provided above the ports and outside of the connector cage. Yet, this placement of the indicator lights consumes additional space outside of the connector cage and increases the overall size of the connector assembly.

BRIEF DESCRIPTION OF THE INVENTION

In one embodiment, a connector assembly includes a shielding cage and a center plate. The shielding cage includes side walls with ports disposed between the side walls. The ports are configured to receive a mating connector through a mating interface of the shielding cage. The center plate is disposed between and couples the side walls to one another. The center plate separates the ports and includes dividing plates and a connecting plate formed with the dividing plates. The dividing plates include spring members extending into the ports to engage the mating connectors received in the ports. The connecting plate extends along the mating interface to interconnect the dividing plates at a location proximate to the mating interface.

In another embodiment, a center plate is configured to retain mating connectors loaded into ports in a shielding cage through a mating interface of the shielding cage. The shielding cage includes side walls of the ports. The center plate includes dividing plates and a connecting plate formed with the dividing plates. The dividing plates separate the ports and couple the side walls. The dividing plates include spring members extending into the ports to engage the mating connectors received in the ports. The connecting plate extends along the mating interface to interconnect the dividing plates at a location proximate to the mating interface.

DETAILED DESCRIPTION OF THE INVENTION

Figure 1:
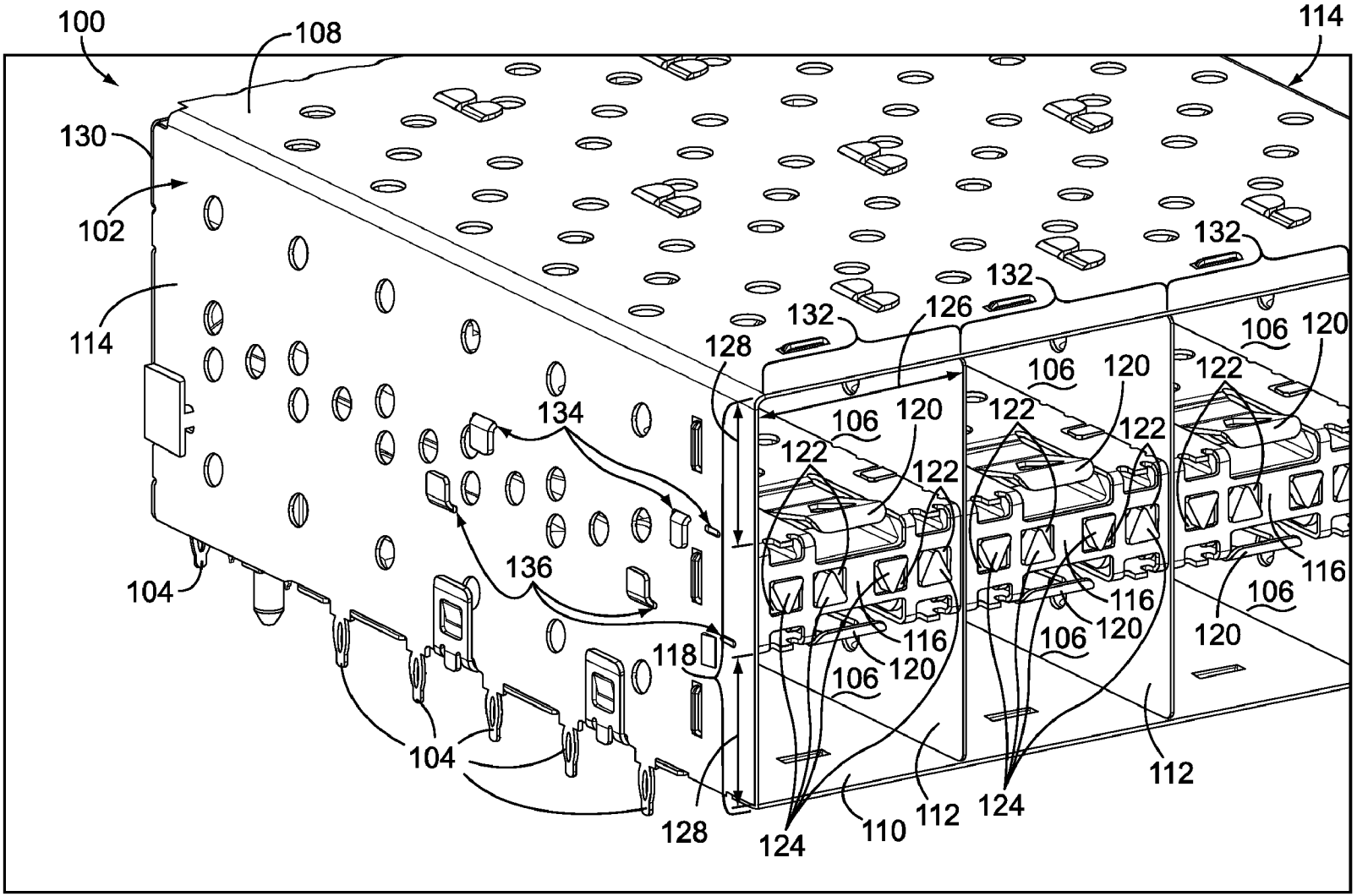
FIG. 1 is a front perspective view of a connector assembly according to one embodiment.

FIG. 1 is a front perspective view of a connector assembly 100 according to one embodiment. While the connector assembly 100 is described herein with particular reference to a vertically stacked receptacle connector assembly, it is to be understood that the benefits herein described are also applicable to other connectors in alternative embodiments. The following description is therefore provided for purposes of illustration, rather than limitation, and is but one potential application of the subject matter herein. For example, the connector assembly 100 may include a horizontally stacked receptacle assembly. The connector assembly 100 includes a shielding connector cage 102 that is shaped to receive a plurality of mating connectors (not shown). The connector cage 102 is a shielding connector cage in one embodiment. For example, the connector cage 102 includes, or is formed from, a conductive material such as a metal. The connector cage 102 and/or one or more components of the connector cage 102 may be stamped and formed from a sheet of metal. In another example, the connector cage 102 includes, or is formed from, a non-conductive material, such as a polymer, that is at least partially plated with a conductive material. The connector cage 102 includes a plurality of grounding pins 104 that mechanically and electrically couples the connector cage 102 with at least one of a substrate and another connector assembly. For example, the grounding pins 104 may be press-fit into corresponding cavities (not shown) in a circuit board (not shown) to retain the connector cage 102 with respect to the circuit board and to electrically connect the connector cage 102 with an electrical ground of the circuit board.

The connector cage 102 includes a plurality of walls. For example, the connector cage 102 includes a top wall 108, an opposing bottom wall 110, a plurality of interior side walls 112, a plurality of exterior side walls 114 and a rear wall 130. The top and bottom walls 108, 110 are approximately parallel to one another. The side walls 112, 114 are approximately parallel to one another and approximately perpendicular to the top and bottom walls 108, 110. The rear wall 130 is approximately perpendicular to the top, bottom and side walls 108, 110, 112, 114. Each of the top, bottom, side and rear walls 108, 110, 112, 130 includes, or is formed from, a conductive material, such as a metal, in one embodiment. For example, the top, bottom, side and rear walls 108, 110, 112, 130 may be stamped and formed from a sheet of metal. Alternatively, each of the top, bottom, side and rear walls 108, 110, 112, 130 may include or be formed from a non-conductive material, such as a polymer, that is at least partially plated with a conductive material. A plurality of the top, bottom, side and rear walls 108, 110, 112, 130 may be homogeneously formed as a unitary body. For example, the top, exterior side and rear walls 108, 114, 130 may be stamped and formed from a common sheet of metal.

The connector cage 102 includes one or more center members, or center plates 116. Each of the center plates 116 extends between one of the exterior side walls 114 and one of the interior side walls 112 or between a pair of the interior side walls 112 in the illustrated embodiment. For example, with the exception of one or more nesting tabs 508 through 530 (shown in FIG. 5) and/or forward tabs 568 through 578 (shown in FIG. 5), the center plates 116 may be mounted in the connector cage 102 so the center plates 116 extend from one side wall 112, 114 to a neighboring side wall 112, 114 without extending beyond either side wall 112, 114. The center plates 116 may couple neighboring side walls 112, 114. For example, the center plates 116 may mechanically and/or electrically couple neighboring side walls 112, 114. The center plates 116 include apertures 122 that permit light to emanate from interior chambers 202 (shown in FIG. 2) of the center plates 116 in one embodiment. Alternatively, the center plates 116 do not include the apertures 122. The apertures 122 may provide openings through which a plurality of light pipes 124 may emit light. The light pipes 124 may protrude through the apertures 122 or may be recessed within the center plates 116 and emit light through the apertures 122.

The center plates 116 and the top, bottom, side and rear walls 108, 110, 112, 114, 130 define a plurality of ports 106 in the connector cage 102. Each of the ports 106 is defined by a portion of the top, bottom and rear walls 108, 110, 130, a portion of each of a pair of opposing side walls 112, 114 and one of the center plates 116. The ports 106 have an interior width 126 that extends between opposing side walls 112, 114 that define the ports 106. The ports 106 have an interior height 128 that extends between the center plate 116 and one of the top and bottom walls 108, 110. The vertical spacing of the ports 106 with respect to one another may be adjusted by changing the vertical height of the center plate 116 in the connector cage 102. The side walls 112, 114 include a plurality of upper and lower slots 134, 136 that are positioned in the side walls 112, 114 to establish the vertical position of the center plates 116. For example, the slots 134, 136 are positioned and shaped to receive one or more of laterally protruding nesting tabs 304 through 314 (shown in FIG. 3) of the center plates 116. The loading of the tabs 304 through 314 into the slots 134, 136 vertically supports and positions the center plates 116 in the connector cage 102.

The ports 106 extend between the rear wall 130 and a mating interface 118 of the connector cage 102. The mating interface 118 includes a plane disposed at the front of the connector cage 102 that is framed by the top, bottom, and exterior side walls 108, 110, 114. The mating interface 118 is approximately parallel to the rear wall 130 and is approximately perpendicular to the top, bottom, and side walls 108, 110, 112, 114.

The ports 106 are shown in FIG. 1 as being arranged in sets 132 of pairs of ports 106. For example, the ports 106 are arranged in FIG. 1 as vertically stacked sets 132 of two ports 106 separated by the center plate 116, with a plurality of sets 132 of the ports 106 being adjacent to one another. In another embodiment, the ports 106 may be disposed in a different arrangement. For example, a different number of ports 106 may be provided in each set 132 of ports 106 and/or a different number of sets 132 of ports 106 may be provided in the connector cage 102. In another example, the ports 106 in each set 132 may be oriented horizontally rather than vertically, as shown in FIG. 1.

The connector cage 102 receives a mating connector (not shown) in one or more of the ports 106. The mating connectors are placed into communication with the ports 106 by loading the mating connectors into the ports 106. The mating connectors are loaded into the ports 106 to mate with one or more connectors 200 (shown in FIG. 2) housed within the connector cage 102. The mating connectors are loaded into the ports 106 through the mating interface 118 of the connector cage 102. A spring member 120 of the center plate 116 engages the mating connector inserted into a corresponding port 106 to retain the mating connector in the port 106. The spring member 120 may include a latch that engages the mating connector, for example. In one embodiment, the light pipes 124 emit an indicator light through corresponding apertures 122 in the center plates 116 to indicate whether a mating connector is in communication with a connector 200 in a corresponding port 106. The indicator light indicates whether a mating connector is loaded into the port 106 and/or is in communication with a corresponding mating connector in the port 106. For example, a light pipe 124 in a center plate 116 that defines a bottom side of a port 106 may emit light through an aperture 122 in that center plate 116 when a mating connector is loaded into that port 106 and in communication with a corresponding mating connector.

Figure 2:
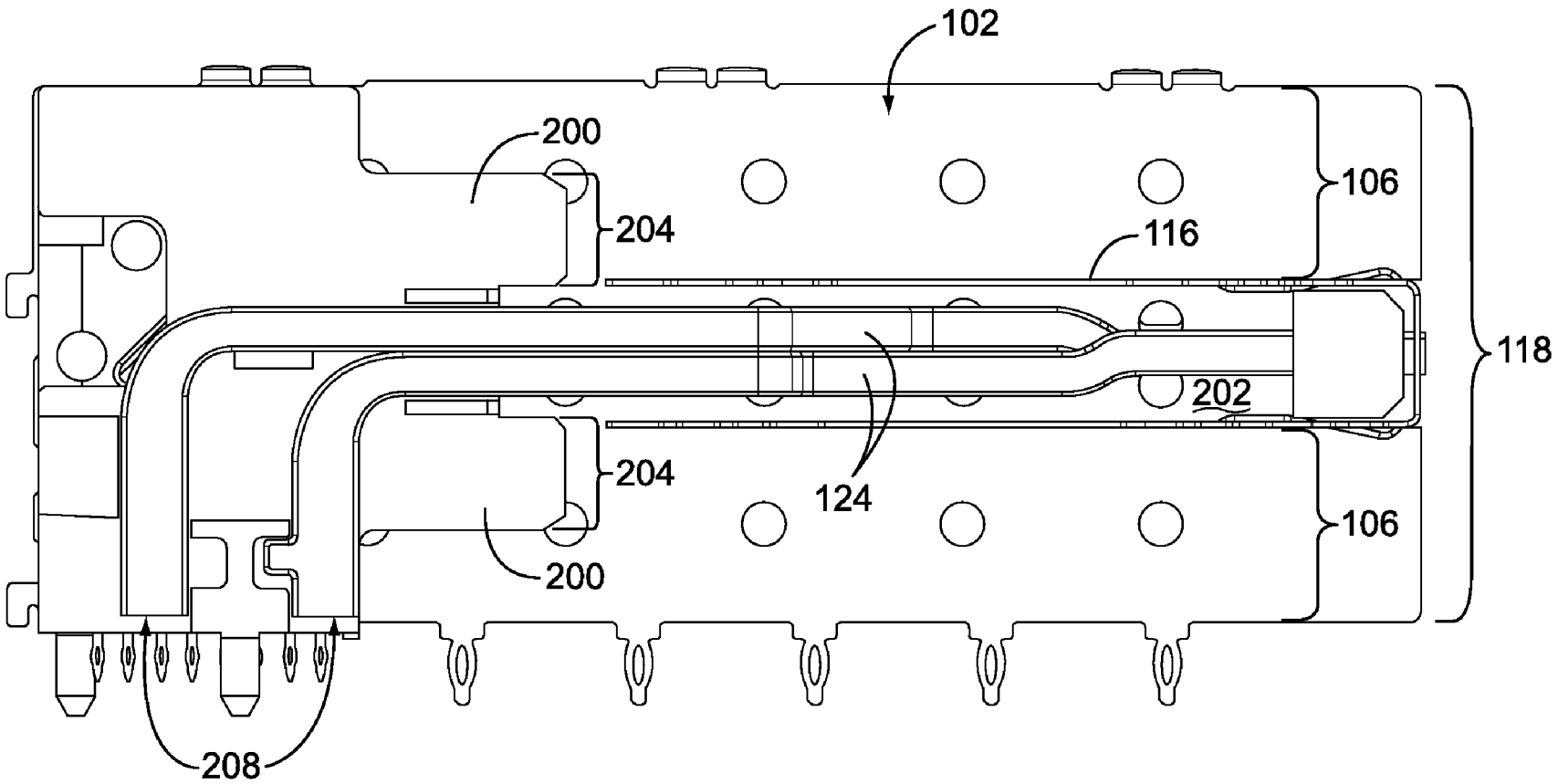
FIG. 2 is a side elevational view of the connector assembly shown in FIG. 1 with top, bottom, exterior side, and rear walls of the connector assembly and shown in FIG. 1 removed.

FIG. 2 is a side elevational view of the connector assembly 100 with the top, bottom, exterior side, and rear walls 108, 110, 114, 130 (shown in FIG. 1) removed. The top, bottom exterior side, and rear walls 108, 110, 114, 130 are removed to illustrate the connectors 200 and light pipes 124 housed in the connector cage 102. The connectors 200 include mating faces 204 that mate with the mating connectors (not shown) loaded into the ports 106. The center plates 116 each define an interior chamber 202. The interior chamber 202 is partially enclosed by a plurality of the side walls 112, 114 on opposing sides of the center plate 116. The interior chamber 202 accommodates one or more of the light pipes 124. For example, the light pipes 124 may pass through the interior chamber 202 from a location that is proximate to a light source end 208 of the light pipes 124 to a location that is proximate to the mating interface 118 of the connector cage 102. The light source end 208 is the end of the light pipes 124 that receives light emanating from a light source (not shown), such as a light emitting diode ("LED"). The light passes through the light pipes 124 and is emitted from the light pipes 124 through the apertures 122 (shown in FIG. 1). The indicator lights thus may be provided without using one or more of the ports 106 in the connector assembly 100.

Figure 3:
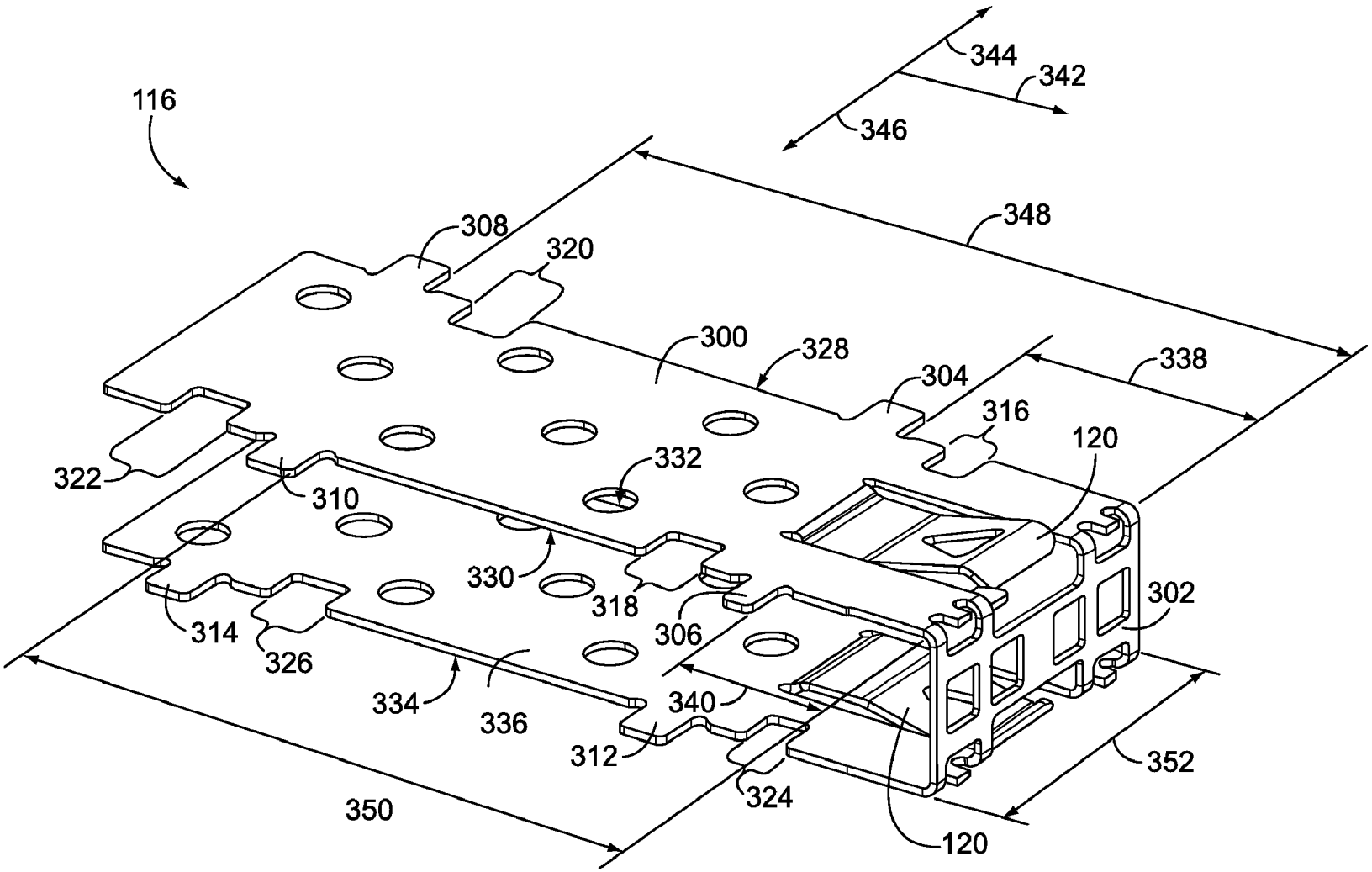
FIG. 3 is a perspective view of a center plate shown in FIG. 1.

FIG. 3 is a perspective view of the center plate 116. The center plate 116 includes a plurality of dividing plates 300, 336 interconnected by a connecting plate 302. The center plate 116 is homogeneously formed as a unitary body in one embodiment. For example, the dividing and connecting plates 300, 336, 302 may be stamped and formed from a common sheet of a conductive material, such as metal. Alternatively, the center plate 116 includes, or is formed from, a non-conductive material, such as a polymer, that is at least partially plated with a conductive material. The dividing plates 300, 336 define top and/or bottom sides of the ports 106 (shown in FIG. 1) in the set 132 of ports 106. For example, the dividing plate 300 defines a bottom side of a top port 106 in the set 132 of ports 106 and the dividing plate 336 defines a top side of a bottom port 106 in the set 132 of ports 106. The connecting plate 302 extends between the dividing plates 300, 336 and between the side walls 112, 114 for a plurality of the ports 106 and prevents electromagnetic interference inside the chamber 202 (shown in FIG. 2) from radiating from the center plate 116 through the mating interface 118 (shown in FIG. 1). The center plate 116 can prevent or reduce the amount of electromagnetic interference that escapes from the chamber 202 through the mating interface 118 without requiring additional components or parts to be added to the connector assembly 100 (shown in FIG. 1) in one embodiment.

Each of the dividing plates 300, 336 includes the spring member 120 to engage and retain a mating connector (not shown). The dividing plates 300, 336 are approximately parallel to one another and the connecting plate 302 is approximately perpendicular to the dividing plates 300. When the connector assembly 100 is assembled, the dividing plates 300, 336 are approximately parallel to the top and bottom walls 108, 110 (shown in FIG. 1) of the connector cage 102 (shown in FIG. 1) and are approximately perpendicular to the rear and side walls 130, 112, 114 (shown in FIG. 1) and to the mating interface 118 (shown in FIG. 1). The connecting plate 302 is approximately perpendicular to the top, bottom, and side walls 108, 110, 112, 114 and is approximately parallel to the rear wall 130 and the mating interface 118.

The nesting tabs 304 through 314 laterally protrude from opposing sides 328, 330, 332, 334 of the dividing plates 300, 336. For example, the nesting tabs 304, 308 protrude from the side 328, the nesting tabs 306, 310 protrude from the side 330, and the nesting tabs 312, 314 protrude from the side 334. Although not visible in the view shown in FIG. 3, the side 332 may include a plurality of laterally protruding nesting tabs similar to one or more of the nesting tabs 304 through 314. In one embodiment, a plurality of the nesting tabs 304 through 314 is arranged in one or more corresponding pairs of nesting tabs. For example, the nesting tabs 304, 306 may be arranged in one pair of nesting tabs and the nesting tabs 308, 310 may be arranged in another pair of nesting tabs. Similarly, the nesting tab 314 may be arranged in a pair of nesting tabs with another nesting tab (not shown) that laterally protrudes from the side 332 and the nesting tab 312 may be arranged in another pair of nesting tabs with a nesting tab (not shown) that laterally protrudes from the side 332.

The nesting tabs 304 through 314 in each pair of nesting tabs may be offset by different distances from the connecting plate 302. For example, in the pair of nesting tabs that includes the nesting tabs 304, 306, the nesting tab 304 is offset from the connecting plate 302 by a distance 338 that is less than a distance 340 that the nesting tab 306 is offset from the connecting plate 302. In another example, in the pair of nesting tabs that includes the nesting tabs 308, 310, the nesting tab 308 is offset from the connecting plate 302 by a distance 348 that is greater than a distance 350 that the nesting tab 310 is offset from the connecting plate 302. Although not visible in the view illustrated in FIG. 3, the pair of nesting tabs that includes the nesting tab 312 and the corresponding nesting tab protruding from the side 332 similarly may be offset from the connecting plate 302 by different distances along the direction 342, and the pair of nesting tabs that includes the nesting tab 314 and the corresponding nesting tab protruding from the side 332 may be offset from the connecting plate 302 by different distances along the direction 342. In the illustrated embodiment, the distances 338, 340, 348, 350 are measured parallel to a direction 342 that is transverse to directions 344, 346 in which the nesting tabs 304 through 314 laterally protrude from the center plate 116.

As shown in FIG. 1, the positions of the center plates 116 in the connector cage 102 define the height 128 and the width 126 of the ports 106. For example, the locations of the slots 134, 136 in the side walls 112, 114 can be changed to adjust the location of the center plates 116 and thus the height 128 of the ports 106. The width 126 of the ports 106 that extends between opposing side walls 112, 114 can be adjusted by changing an exterior width 352 of the center plate 116. The exterior width 352 is measured in a direction parallel to the directions 344, 346.

Figure 4:
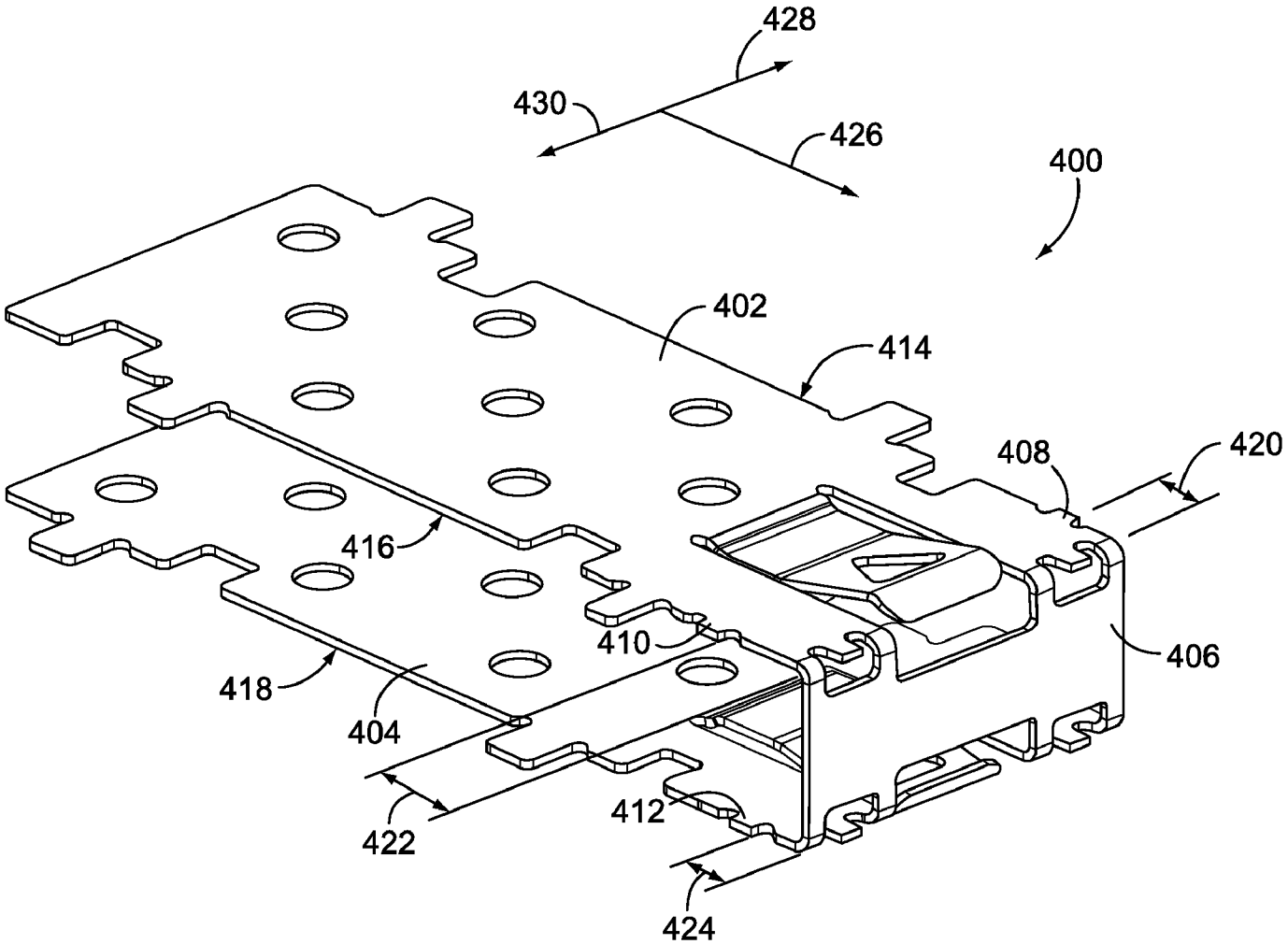
FIG. 4 is a perspective view of a center plate according to another embodiment.

FIG. 4 is a perspective view of a center plate 400 according to another embodiment. Similar to the center plate 116 (shown in FIG. 1), the center plate 400 includes a plurality of dividing plates 402, 404 coupled by a connecting plate 406. The dividing plates 402, 404 may be similar to the dividing plates 300, 336 (shown in FIG. 3) and the connecting plate 406 may be similar to the connecting plate 302 (shown in FIG. 3). In the illustrated embodiment, the connecting plate 406 does not include the apertures 122 (shown in FIG. 1) present in the connecting plate 302. Also in the illustrated embodiment, the dividing plates 402, 404 include a plurality of laterally protruding forward tabs 408, 410, 412. The dividing plate 402 includes the forward tab 408 laterally protruding from one side 414 of the dividing plate 402 and the forward tab 410 laterally protruding from an opposing side 416 of the dividing plate 402. The dividing plate 404 includes the forward tab 412 laterally protruding from one side 418 of the dividing plate 404 and, although not shown in the view of FIG. 4, an opposing side of the dividing plate 404 includes a forward tab laterally protruding from the opposing side.

The forward tabs 408, 410, 412 and the forward tab opposing the forward tab 412 may be arranged in a plurality of pairs. The forward tabs 408, 410, 412 and the forward tab opposing the forward tab 412 in each pair may be offset from the connecting plate 406 by different distances. For example, in the pair of tabs that includes the forward tabs 408, 410, the forward tab 408 is offset from the connecting plate 406 by a distance 420 that is less than a distance 422 that the forward tab 410 is offset from the connecting plate 406. In another example, in the pair of forward tabs that includes the forward tab 412 and the forward tab protruding from the side opposing the side 418, the forward tab 412 may be offset from the connecting plate 406 by a distance 424 that is smaller than the distance that the forward tab that protrudes from the side opposing the side 418 is offset from the connecting plate 406. In the illustrated embodiment, the distances 420, 422, 424 are measured parallel to a direction 426 that is transverse to directions 428, 430 in which the forward tabs 408, 410, 412 laterally protrude from the center plate 400.

Figure 5:
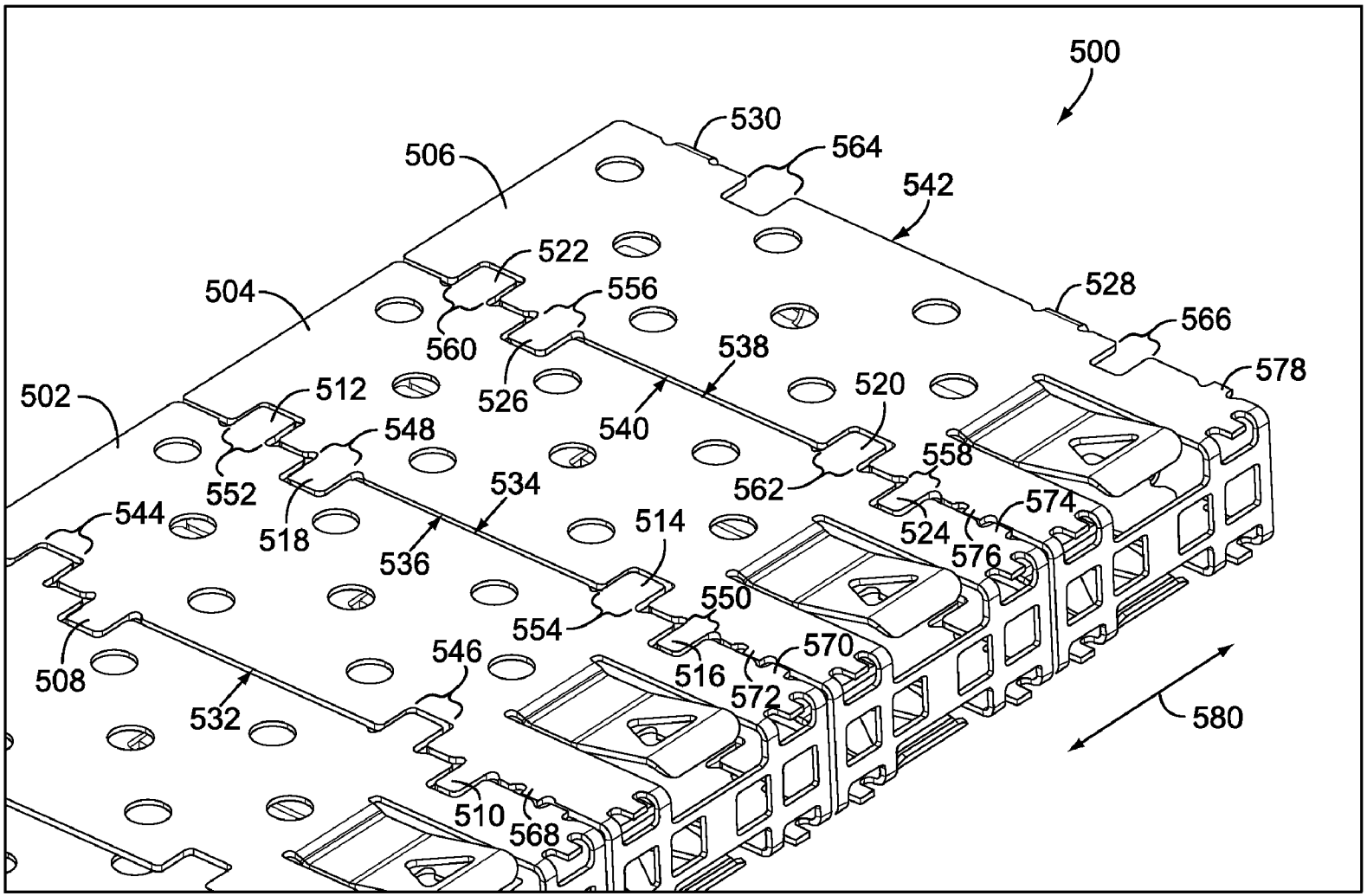
FIG. 5 is a perspective view of a set of co-nested center plates according to one embodiment.

FIG. 5 is a perspective view of a set 500 of co-nested center plates 502, 504, 506 according to one embodiment. Each of the center plates 502, 504, 506 may be similar to one or more of the center plates 116, 400 (shown in FIGS. 1 and 4). The center plates 502, 504, 506 each include a plurality of nesting tabs 508 through 530 laterally protruding from opposing sides 532 through 542 of each center plate 502, 504, 506. The nesting tabs 508 through 530 protrude from the center plates 502, 504, 506 in directions parallel to a lateral axis 580 in the illustrated embodiment. The lateral axis 580 is approximately transverse to the sides 532 through 542.

The nesting tabs 508 through 530 are similar to the nesting tabs 304 through 314 (shown in FIG. 3) in one embodiment. In the illustrated embodiment, the center plate 502 includes nesting tabs 508, 510, 512, 514, the center plate 504 includes nesting tabs 516, 518, 520, 522 and the center plate 506 includes nesting tabs 524, 526, 528, 530. Although not visible in the view shown in FIG. 5, each of the center plates 502, 504, 506 may include a lower dividing plate similar to the lower dividing plate 336 (shown in FIG. 3) and/or the lower dividing plate 404 (shown in FIG. 4). For example, the center plates 502, 504, 506 may include lower dividing plates that have laterally protruding nesting tabs (not shown) similar to one or more of the nesting tabs 304 through 314 and/or the nesting tabs 508 through 530.

The center plates 502, 504, 506 each include a plurality of nesting slots 544 through 566 in the opposing sides 532 through 542 of each center plate 502, 504, 506. The nesting slots 544 through 562 are similar to the nesting slots 316 through 326 (shown in FIG. 3) in one embodiment. In the illustrated embodiment, the center plate 502 includes the nesting slots 544 through 550, the center plate 504 includes the nesting slots 552 through 558, and the center plate 506 includes the nesting slots 560 through 566. Although not visible in the view shown in FIG. 5, each of the center plates 502, 504, 506 may include a lower dividing plate similar to the lower dividing plate 336 (shown in FIG. 3) and/or the lower dividing plate 404 (shown in FIG. 4). For example, the center plates 502, 504, 506 may include lower dividing plates that have nesting slots (not shown) similar to one or more of the nesting slots 316 through 326 and/or the nesting slots 544 through 566.

The nesting tabs 508 through 530 and the nesting slots 544 through 566 are positioned and shaped to be received within one another such that the center plates 502, 504, 506 can co-nest within one another. For example, the nesting tabs 512, 514 of the center plate 502 may be received in the nesting slots 552, 554 of the neighboring center plate 504; the nesting tabs 516, 518 of the center plate 504 may be received in the nesting slots 548, 550 of the neighboring center plate 502; the nesting tabs 520, 522 of the center plate 504 may be received in the nesting slots 560, 562 of the neighboring center plate 506; and the nesting tabs 524, 526 of the center plate 506 may be received in the nesting slots 556, 558 of the neighboring center plate 504. Additional center plates may similarly co-nest with neighboring center plates, including the center plates 502, 504, 506. By way of example only, one or more of the nesting tabs 508 through 530 may extend through the upper and/or lower slots 134, 136 (shown in FIG. 1) of the side walls 112, 114 (shown in FIG. 1) and be received in corresponding nesting slots 544 through 566. The side walls 112, 114 may be disposed between neighboring center plates 502, 504, 506. For example, the interior side walls 112 may be disposed between the center plates 502, 504 and between the center plates 504, 506. The exterior side wall 114 may be disposed proximate to the side 542 of the center plate 506. The nesting tabs 528, 530 may be inserted through one or more of the upper slots 134 and bent such that the center plate 506 is retained in place with respect to the exterior side wall 114.

The center plates 502, 504, 506 include a plurality of forward tabs 568 through 578. The forward tabs 568 through 578 protrude from the center plates 502, 504, 506 in directions parallel to the lateral axis 580 in one embodiment. The forward tabs 568 through 578 are similar to the forward tabs 408, 410, 412 in one embodiment. The forward tabs 568 through 578 of one center plate 502, 504, 506 engage the sides 532 through 542 of a neighboring center plate 502, 504, 506. For example, the forward tab 570 of the center plate 502 engages the side 536 of the neighboring center plate 504; the forward tab 572 of the center plate 504 engages the side 534 of the neighboring center plate 502; the forward tab 574 of the center plate 504 engages the side 540 of the neighboring center plate 506; and the forward tab 576 of the center plate 506 engages the side 538 of the neighboring center plate 504. The engagement between one or more of the forward tabs 568 through 578 and one or more of the sides 532 through 542 inhibits lateral displacement of one or more of the center plates 502, 504, 506 in either direction parallel to the lateral axis 580. For example, the engagement between the forward tabs 568 through 578 and the sides 532 through 542 can reduce the distance that one or more of the center plates 502, 504, 506 can be displaced in a direction parallel to the lateral axis 580 relative to the other center plates 502, 504, 506.

Figure 6:
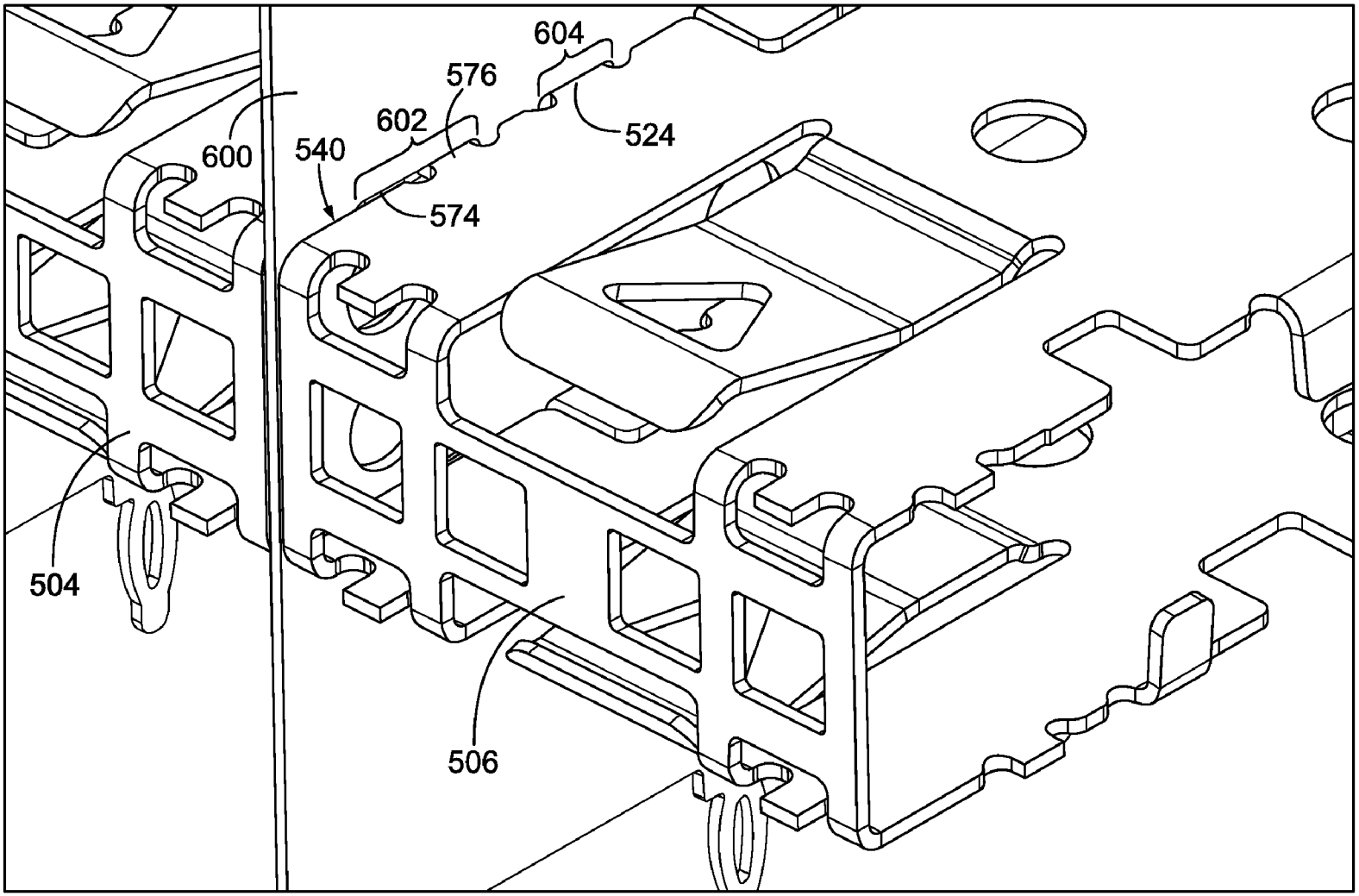
FIG. 6 is a perspective view of the center plates shown in FIG. 5 and a side wall between the center plates according to one embodiment.

FIG. 6 is a perspective view of the center plates 504, 506 and a side wall 600 between the center plates 504, 506 according to one embodiment. The side wall 600 is disposed between the center plates 504, 506 in a manner similar to the location of one or more of the interior side walls 112 (shown in FIG. 1) between neighboring center plates 116 (shown in FIG. 1). The side wall 600 may be disposed between a different pair of the center plates 502, 504, 506. The side wall 600 includes a plurality of upper slots 602, 604 that are similar to the upper slots 134 (shown in FIG. 1). The forward tabs 568 through 578 (shown in FIG. 5) may engage one or more of the sides 532 through 542 (shown in FIG. 5) of neighboring center plates 502, 504, 506 (shown in FIG. 5) through the upper slot 602. For example, the forward tab 576 of the center plate 506 may extend through the upper slot 602 to engage the side 538 (shown in FIG. 5) of the center plate 504, and the forward tab 574 of the center plate 504 may extend through the upper slot 602 to engage the side 540 of the center plate 506. The nesting tabs 508 through 530 (shown in FIG. 5) may be received in one or more of the nesting slots 544 through 566 (shown in FIG. 5) of neighboring center plates 502, 504, 506 through the upper slot 604. For example, the nesting tab 524 may extend through the upper slot 604 and be received in the nesting slot 558 of the center plate 504.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and merely are example embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §1102, sixth paragraph, unless and until such claim limitations expressly use the phrase "means for" followed by a statement of function void of further structure.

What is claimed is:

1. A connector assembly comprising:

a shielding cage comprising side walls with ports disposed between the side walls, the ports configured to receive mating connectors through a mating interface of the shielding cage; and first and second center plates each extending between the side walls, the first and second center plates aligned and adjacent one another, each of the first and second center plates comprising dividing plates interconnected by a connecting plate formed with the dividing plates proximate to the mating interface of the shielding cage, the dividing plates of the first and second center plates including a forward tab and a nesting tab protruding from a common side of the dividing plates and a nesting slot extending into the side of the dividing plates, wherein the nesting tab of the first center plate is received into the nesting slot of the second center plate and the forward tab of each of the first and second center plates abuts the common side of the other one of the first and second center plates to prevent lateral displacement of the first and second center plates with respect to one another.

2. The connector assembly of claim 1, wherein the connecting plates are disposed transverse to the side walls.

3. The connector assembly of claim 1, wherein the center plates define chambers configured to hold light pipes.

4. The connector assembly of claim 1, wherein the connecting plates comprise apertures configured to permit an indicator light to emanate from the connector assembly, the indicator light communicating whether at least one of the mating connectors is in communication with at least one of the ports.

5. The connector assembly of claim 1, wherein the connecting plates prevent electromagnetic interference between the dividing plates from radiating out of the connector assembly.

6. The connector assembly of claim 1, wherein the first and second center plates are formed by stamping and forming the connecting plates and the dividing plates of each of the first and second center plates from sheets of conductive material.

7. The connector assembly of claim 1, wherein the nesting tabs project from the side of each of the first and second center plates by a larger distance than the forward tabs of the corresponding one of the first and second center plates.

8. The connector assembly of claim 1, wherein the forward tab of the first center plate is offset from the connecting plate of the first center plate by a distance that is larger than a distance that the forward tab of the second center plate is offset from the connecting plate of the second center plate.

9. The connector assembly of claim 1, wherein at least one of the side walls of the shielding cage includes a slot through which the forward tab of each of the first and second center plates extends to abut against the other one of the first and second center plates.

10. A connector assembly comprising:

a shielding cage comprising side walls with ports disposed between the side walls, the ports configured to receive mating connectors through a mating interface of the shielding cage; and first and second center plates extending between the side walls, the first and second center plates aligned and adjacent one another, each of the first and second center plates comprising dividing plates interconnected by a connecting plate formed with the dividing plates proximate to the mating interface of the shielding cage, the dividing plates separating the ports from one another and including forward tabs and nesting tabs protruding from opposing sides of at least one of the dividing plates and nesting slots extending into the sides of the at least one of the dividing plates, wherein the nesting tabs and the nesting slots of the first and second center plates co-nest with one another and the forward tabs of the first and second center plates engage the sides of the other of the first and second center plates to prevent lateral movement of the first and second center plates.

11. The connector assembly of claim 10, wherein the first and second center plates define chambers in the shielding cage, the chambers configured to accommodate light pipes.

12. The connector assembly of claim 10, wherein the connecting plates comprise apertures that are configured to permit indicator lights to emanate from the center plates, the indicator lights indicating whether at least one of the mating connectors is in communication with at least one of the ports of the shielding cage.

13. The connector assembly of claim 10, wherein the connecting plates prevent electromagnetic interference from radiating out of the connector assembly.

14. The connector assembly of claim 10, wherein each of the first and second center plates comprises a common sheet of conductive material that is stamped and formed to produce the dividing plates and the connecting plate of the corresponding one of the first and second center plates.

15. The connector assembly of claim 10, wherein the nesting tabs project from the sides of each of the first and second center plates by a larger distance than the forward tabs of the corresponding one of the first and second center plates.

16. The connector assembly of claim 10, wherein the forward tabs of the first center plate are offset from the connecting plate of the first center plate by distances that are larger than distances that the forward tabs of the second center plate are offset from the connecting plate of the second center plate.

17. The connector assembly of claim 10, wherein the side walls of the shielding cage include slots through which the forward tabs of the first and second center plates extend to abut against the other one of the first and second center plates.

* * * * *